US007377624B2

(12) United States Patent
Park et al.

(10) Patent No.: US 7,377,624 B2
(45) Date of Patent: May 27, 2008

(54) INK JET HEAD HAVING CHANNEL DAMPER AND METHOD OF FABRICATING THE SAME

(75) Inventors: Yong-Shik Park, Seongnam-si (KR); Kwang-Ryul Kim, Suwon-si (KR); Sung-Joon Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 298 days.

(21) Appl. No.: 11/153,497

(22) Filed: Jun. 16, 2005

(65) Prior Publication Data

US 2005/0285907 A1 Dec. 29, 2005

(30) Foreign Application Priority Data

Jun. 25, 2004 (KR) ..... 10-2004-0048555

(51) Int. Cl.
*B41J 2/05* (2006.01)

(52) U.S. Cl. ..... 347/56; 347/67; 347/94

(58) Field of Classification Search ..... 347/20, 347/56, 61–65, 92–94, 44, 47, 67; 29/611, 29/890.1

See application file for complete search history.

(56) References Cited

U.S. PATENT DOCUMENTS 4,794,410 A 12/1988 Taub et al. ..... 347/92
4,882,595 A 11/1989 Trueba et al. ..... 347/92
5,412,413 A 5/1995 Sekiya et al. ..... 347/65
5,635,966 A * 6/1997 Keefe et al. ..... 347/65
6,626,522 B2 * 9/2003 Rapp et al. ..... 347/65

FOREIGN PATENT DOCUMENTS

EP 0314486 5/1989
EP 1426187 6/2004

OTHER PUBLICATIONS

European Search Report dated Mar. 30, 2007 issued in EP 05253859.2.

* cited by examiner

*Primary Examiner*—Juanita D Stephens
(74) *Attorney, Agent, or Firm*—Stanzione & Kim, LLP

(57) ABSTRACT

An ink jet head having a channel damper, and a method of fabricating the same. The ink jet head includes a heat-generating resistor disposed on a substrate to generate pressure for ink ejection, a chamber layer disposed on the substrate to enclose the heat-generating resistor and having a first height from the substrate in order to provide at least one opened portion, and a channel damper disposed at the opened portion to completely enclose the heat-generating resistor together with the chamber layer and having a second height lower than the first height is disposed at the opened portion. A nozzle layer having a nozzle corresponding to the heat-generating resistor is disposed to be in contact with an upper surface of the chamber layer.

47 Claims, 22 Drawing Sheets

INK JET HEAD HAVING CHANNEL DAMPER AND METHOD OF FABRICATING THE SAME

CROSS-REFERENCE TO RELATED APPLICATION

This application claims the benefit of Korean Patent Application No. 2004-48555, filed Jun. 25, 2004, the contents of which are hereby incorporated herein by reference in their entirety.

BACKGROUND OF THE INVENTION

1. Field of the Invention

The present general inventive concept relates to an ink jet head and a method of fabricating the same and more particularly, to an ink jet head having a channel damper and a method of fabricating the same.

2. Description of the Related Art

An ink jet recording device functions to print an image by ejecting fine droplets of print ink to a desired position on a recording medium. Such an ink jet recording device has been widely used since its price is low and numerous color images can be printed at high resolution. The ink jet recording device basically includes an ink jet head for actually ejecting ink, and an ink container in fluid communication with the ink jet head. An ink ejection type of the ink jet recording device is classified into a thermal type using an electro-thermal transducer, and a piezo-electric type using an electromechanical transducer.

The ink jet head used in the thermal type of the ink jet recording device includes a heat-generating resistor provided as the electrothermal transducer, and an ink chamber for temporarily storing the ink to be ejected to the recording medium. The ink chamber is defined to include the heat-generating resistor within its interior using a barrier structure, such as a chamber layer, disposed adjacent to the heat-generating resistor.

A conventional ink jet head having the above barrier structure enclosing three sides of the heat-generating resistor has been disclosed in U.S. Pat. No. 4,794,410, entitled "Barrier Structure for Thermal Ink Jet Print Heads" to Howard H. Taub, et al.

FIG. 1 is a plan view illustrating the barrier structure 3 of the conventional ink jet head disclosed in U.S. Pat. No. 4,794,410.

Referring to FIG. 1, the barrier structure 3 is disposed to enclose three sides of a heat-generating resistor 1. The barrier structure 3 is configured so that three walls are interconnected to each other to enclose the three sides of the heat-generating resistor 1 while a remaining one side of the heat-generating resistor 1 is opened. An ink chamber for containing the heat-generating resistor 1 therein is defined by the barrier structure 3. A portion opened by the barrier structure 3 is provided as an ink channel 5 fluidly communicating with the ink chamber and an ink feed channel (not shown). Ink introduced through the ink feed channel is temporarily stored in the ink chamber through the ink channel 5. The ink stored in the ink chamber is instantly heated by the heat-generating resistor 1 to generate bubbles in the ink. The bubbles increase a pressure in the ink chamber to thereby eject the ink from the ink chamber in a shape of a droplet through a nozzle (not shown). At this time, the ink in the ink chamber is ejected to an exterior through the nozzle, and simultaneously subjected to a back-flow to the ink feed channel through the ink channel 5. The reason for this back-flow phenomenon is that the bubbles generated by the heat-generating resistor 1 are expanded toward the ink feed channel through the ink channel 5. The back-flow phenomenon reduces the pressure required for the ink ejection, thereby decreasing a speed and a straightness of ink droplets ejected from the nozzle. In addition, after the ejection of the ink, a speed of the ink recharged into the ink chamber is also reduced to decrease a frequency of the ink ejection.

The back-flow phenomenon may cause problems in the ink jet head having the barrier structure 3 as shown in FIG. 1. That is, the ink channel 5 fully opens the one side of the heat-generating resistor 1, so that a great deal of the ink back-flows toward the ink feed channel through the ink channel 5 when the ink is ejected. As a result, the speed and the straightness of the ink droplet can be lowered, and the frequency of the ink ejection can be reduced.

To solve the above-mentioned problems, there is a proposal for a method of forming restrictors at both ends of the barrier structure in order to decrease a cross-sectional area of the ink channel. For example, an ink jet head having the restrictor is disclosed in U.S. Pat. No. 4,882,595. Formation of the restrictor permits the back-flow phenomenon of the ink to be decreased, but a recharging speed of the ink into the ink chamber may be reduced due to a reduction of a cross-sectional area of the ink channel.

In conclusion, research on the ink jet head will be continuously required to maximally restrict the expansion of the ink generated by the heat-generating resistor to the exterior of the ink chamber to increase the ejection speed and the straightness of the ink droplet, and simultaneously increase the recharging speed of the ink, so that the frequency of the ink ejection is increased.

SUMMARY OF THE INVENTION

In order to solve the foregoing and/or other problems, it is an aspect of the present general inventive concept to provide an ink jet head having an improved ejection speed and frequency.

It is another aspect of the present general inventive concept to provide a method of fabricating an ink jet head having an improved ejection speed and frequency.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an ink jet head having a channel damper, the ink jet head comprising a heat-generating resistor disposed on a substrate and generating a pressure for ink ejection, a chamber layer disposed on the substrate to enclose the heat-generating resistor to provide at least one opened portion and to have a first height from the substrate, a channel damper disposed on the opened portion to completely enclose the heat-generating resistor together with the chamber layer and to have a second height lower than the first height, and a nozzle layer having a nozzle corresponding to the heat-generating resistor and disposed to be in contact with an upper surface of the chamber layer.

The chamber layer may be made of a single resin layer having a first height from the substrate. The chamber layer may include a lower chamber layer and an upper chamber layer covering the lower chamber layer. The lower chamber layer may be made of the same material layer and has the same height as the channel damper. That is, the lower chamber layer and the channel damper may be the same resin layer disposed to completely enclose the heat-generating resistor.

The channel damper and the lower chamber layer may be spaced apart from the heat-generating resistor by a predetermined distance to enclose the heat-generating resistor, and may be disposed to form a rectangular frame. The channel damper and the lower chamber layer may be disposed to form an annular structure to enclose the heat-generating resistor.

When the channel damper and the lower chamber layer are disposed to form the rectangular frame, the opened portion at which the channel damper is disposed may be provided to open at least one side of the heat-generating resistor. In addition, the opened portion may be provided to open at least one corner of the heat-generating resistor. The opened portion may be provided to open a selected one side of the heat-generating resistor and both end corners of the selected one side of the heat-generating resistor. Further, the opened portion may be provided to open three corners and two sides between the three corners of the heat-generating resistor.

The ink jet head may further include an ink feed channel passing through the substrate. The ink feed channel may be disposed to have a line shape traversing one side of the chamber layer and the channel damper enclosing the heat-generating resistor. In addition, a blocking layer may be disposed on the substrate of the one side of the heat-generating resistor to be spaced apart from the channel damper. The blocking layer may be disposed to have a bar shape parallel to the one side of the heat-generating resistor.

The foregoing and/or other aspects and advantages of the present general inventive concept may also be achieved by providing a method of fabricating the ink jet head, the method including forming a heat-generating resistor on a substrate to generate a pressure for ink ejection, forming a chamber/damper layer on the substrate having the heat-generating resistor to enclose the heat-generating resistor, and forming an upper chamber layer and a nozzle layer on the substrate having the chamber/damper layer, the upper chamber layer being formed on a predetermined region of the chamber/damper layer to define at least one channel damper in the chamber/damper layer corresponding to an area exposed by the upper damper layer, the nozzle layer being in contact with an upper surface of the upper chamber layer and being formed to have a nozzle corresponding to the heat-generating resistor.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
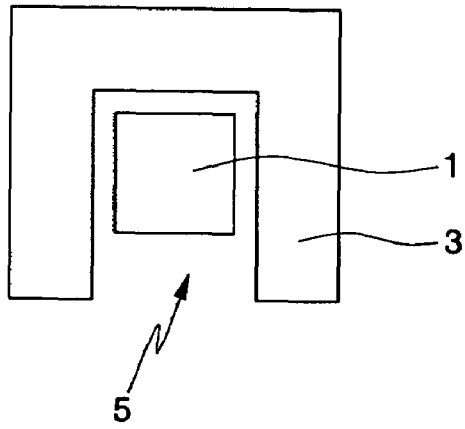
FIG. 1 (PRIOR ART)
FIG. 1 is a plan view illustrating a barrier structure of a conventional ink jet head.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2A:
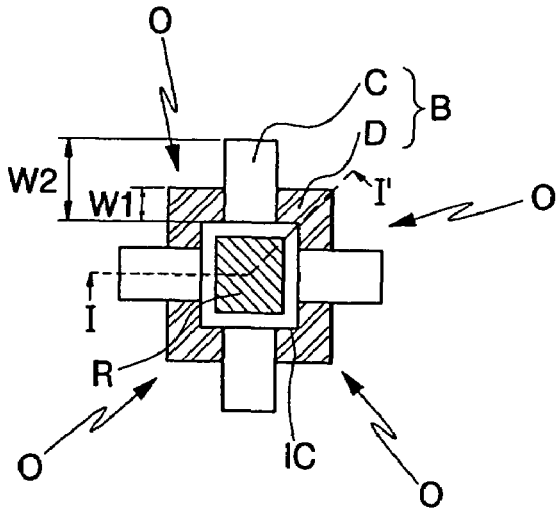
FIG. 2A is a plan view illustrating a barrier structure used with an ink jet head in accordance with an embodiment of the present general inventive concept.
Figure 2B:
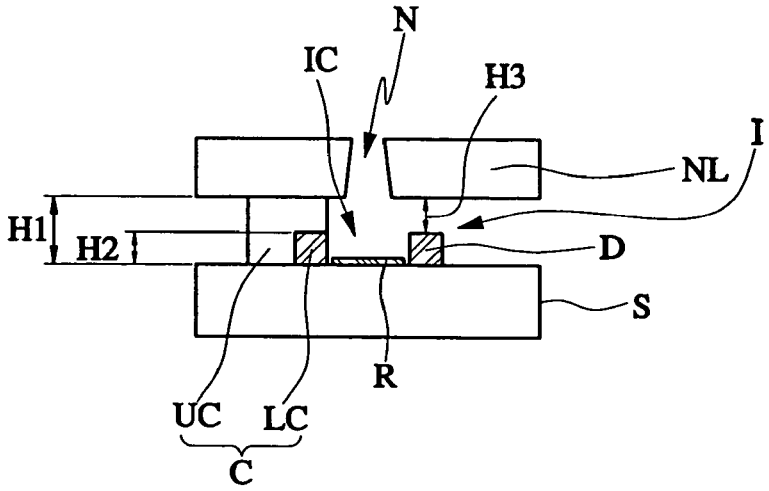
FIG. 2B is a cross-sectional view taken along a line I-I' shown in FIG. 2A.

FIG. 2A is a plan view illustrating a barrier structure used with an ink jet head in accordance with an embodiment of the present general inventive concept, and FIG. 2B is a cross-sectional view taken along a line I-I shown in FIG. 2A. In addition, FIG. 2C is a perspective view illustrating the barrier structure shown in FIG. 2A.

Figure 2C:
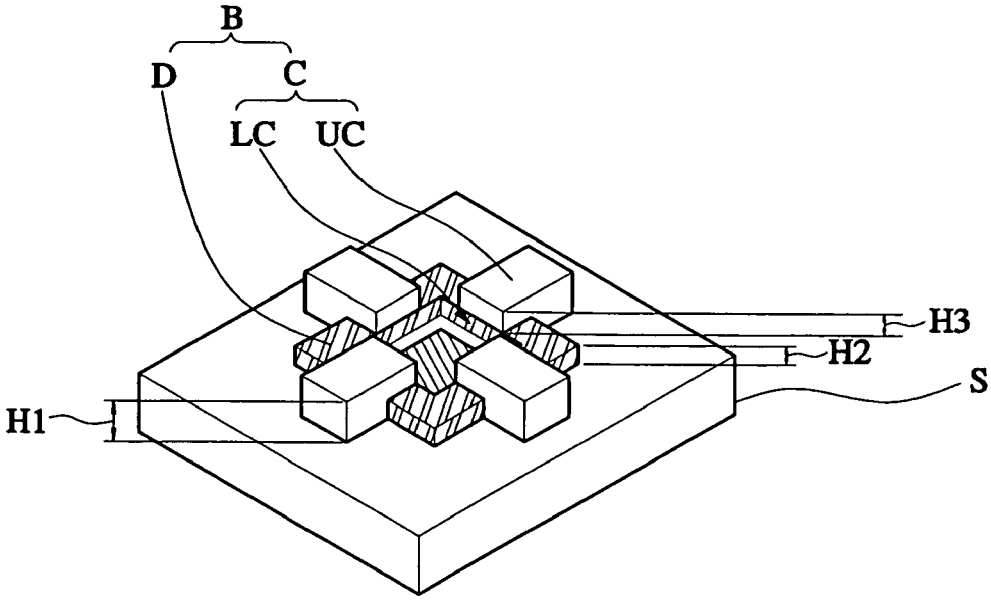
FIG. 2C is a perspective view illustrating the barrier structure shown in FIG. 2A.
Figure 3A:
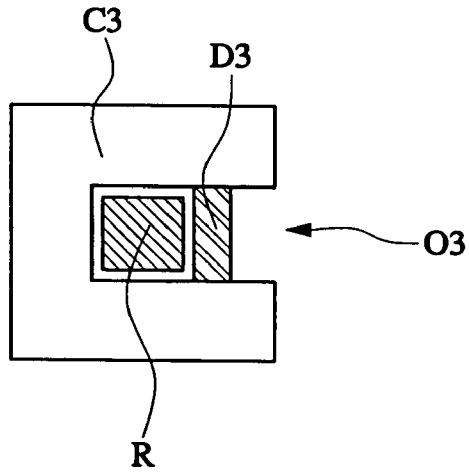
FIGS. 3A to 7B are views illustrating barrier structures in accordance with other embodiments of the present general inventive concept.
Figure 3B:
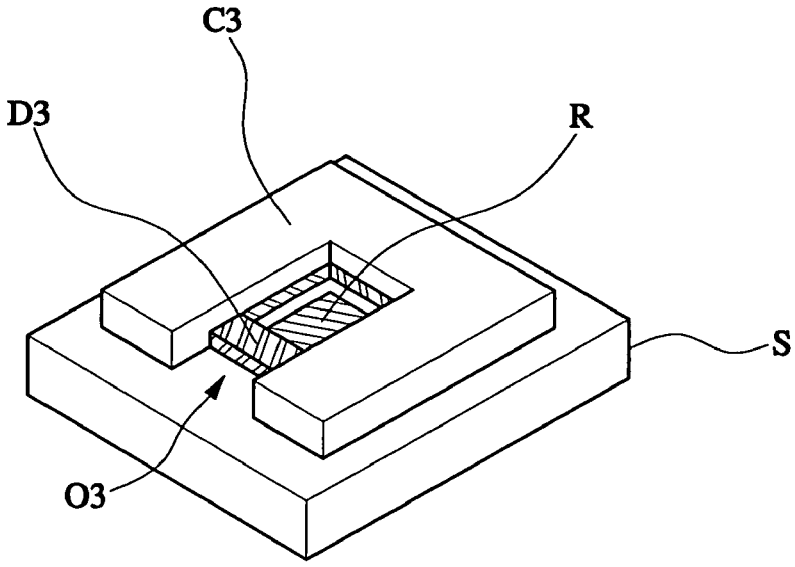
Figure 4A:
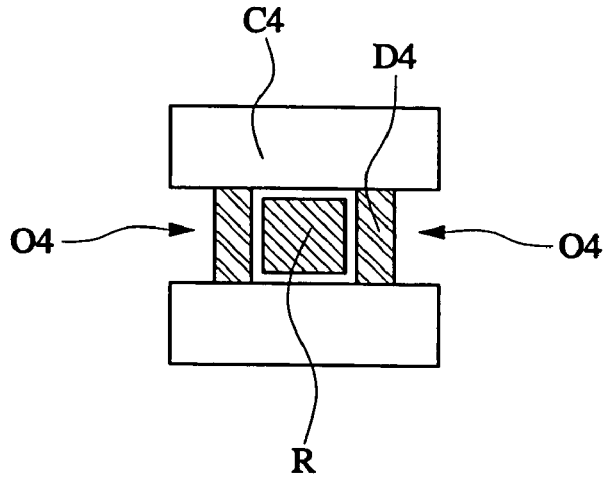
Figure 4B:
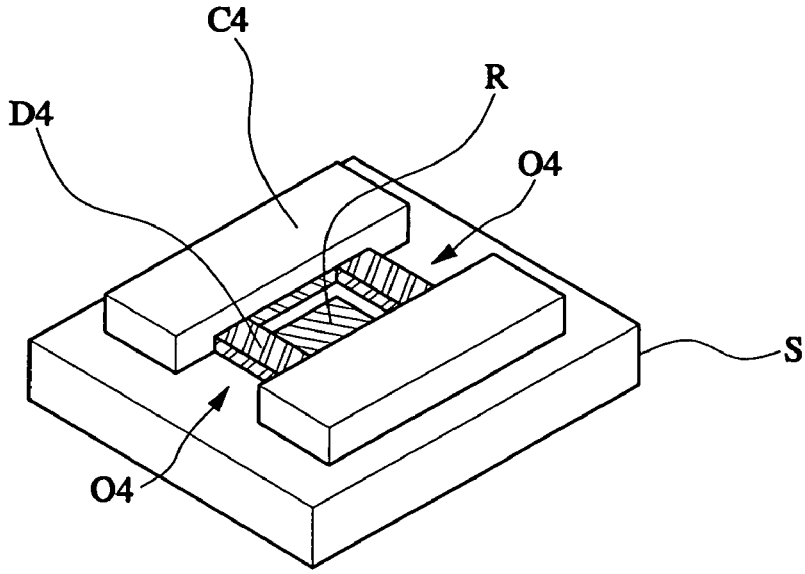
Figure 5A:
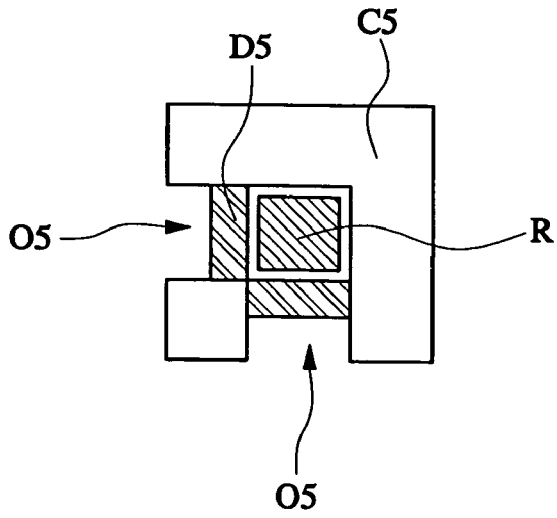
Figure 5B:
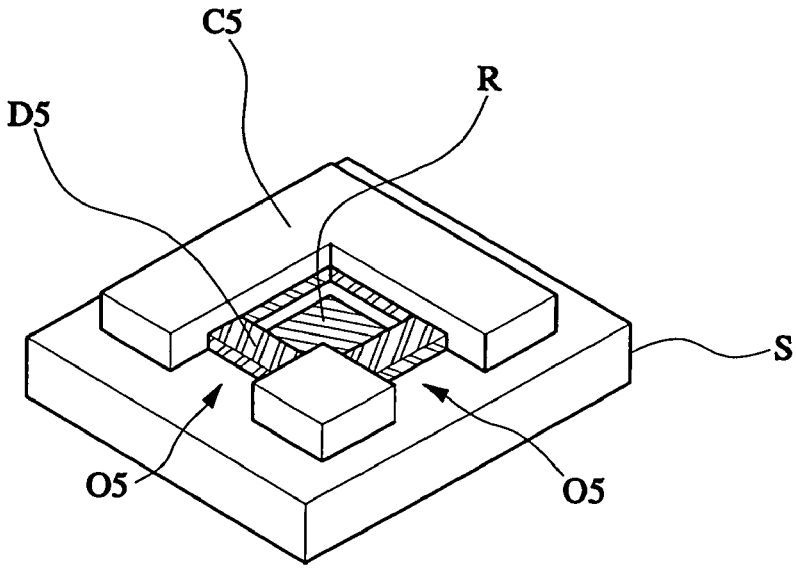
Figure 6A:
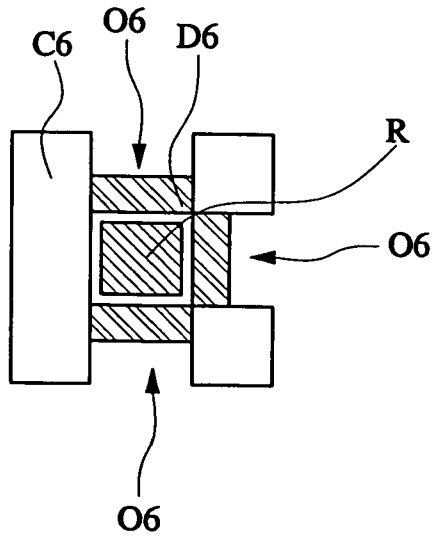
Figure 6B:
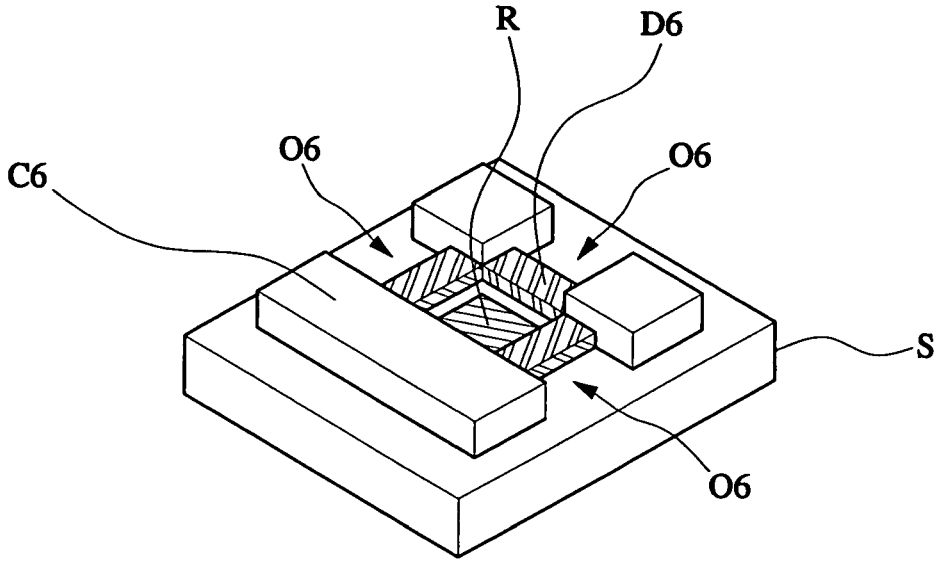
Figure 7A:
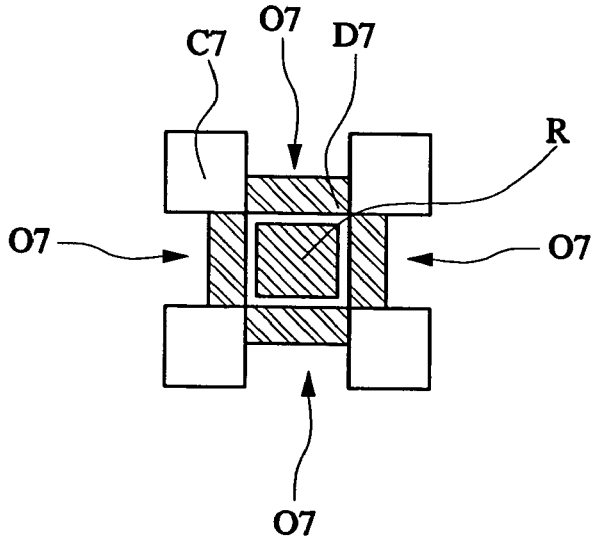
Figure 7B:
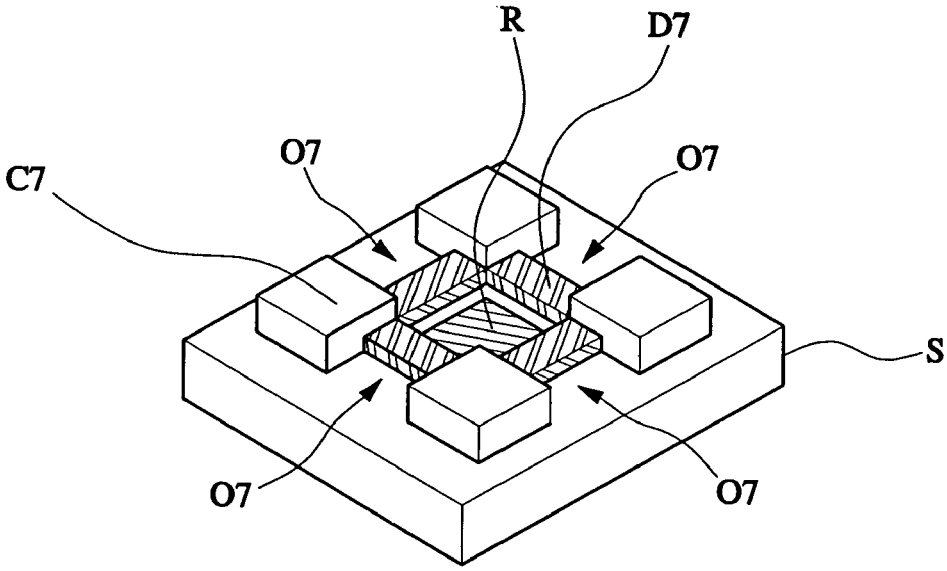
Figure 8A:
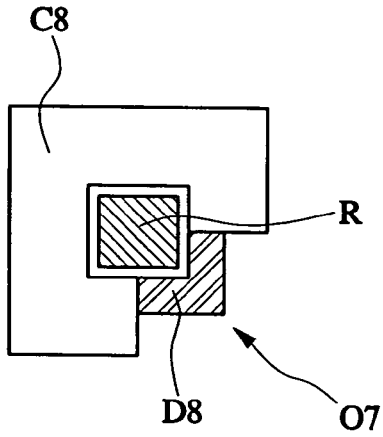
FIGS. 8A to 11B are views illustrating barrier structures in accordance with other embodiments of the present general inventive concept.
Figure 8B:
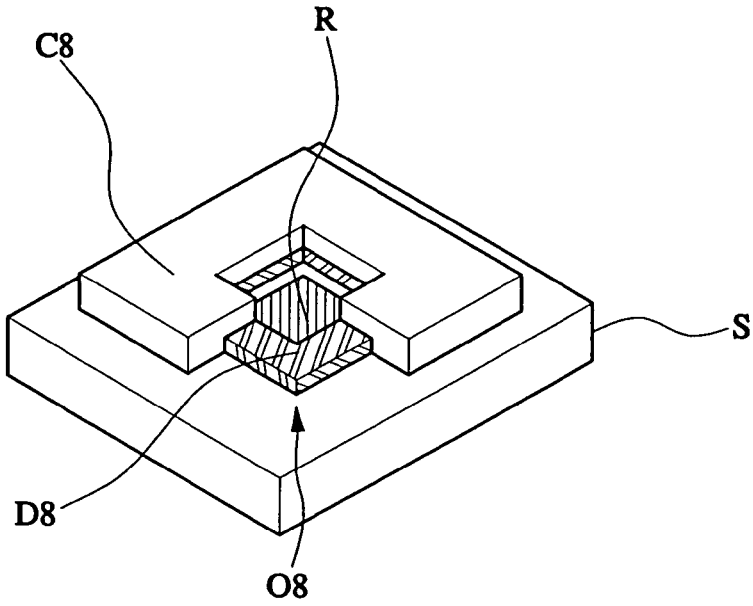
Figure 9A:
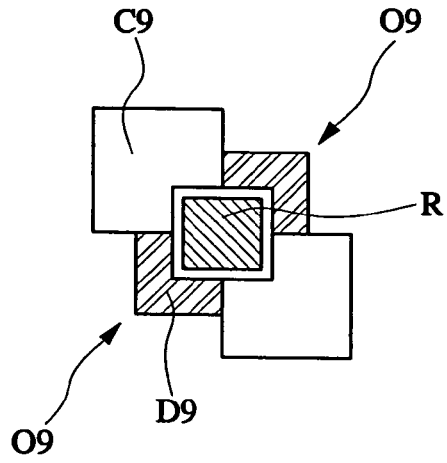
Figure 9B:
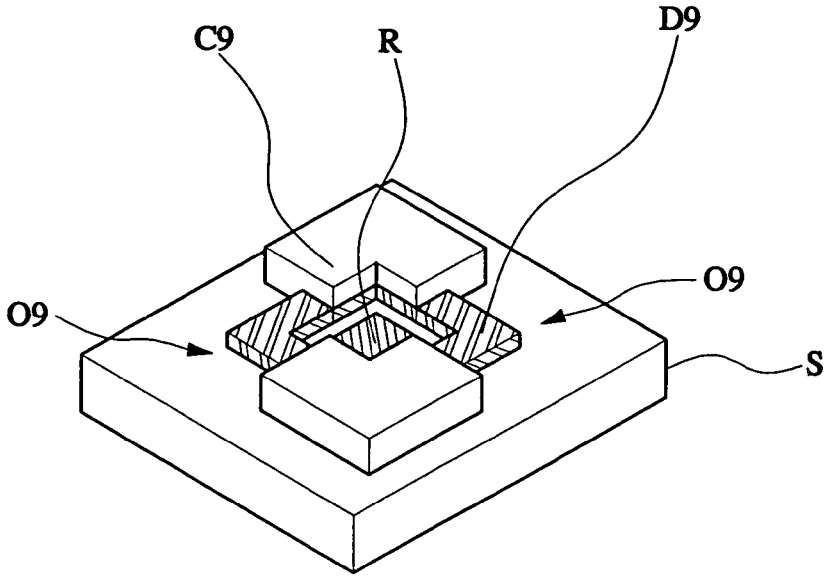
Figure 10A:
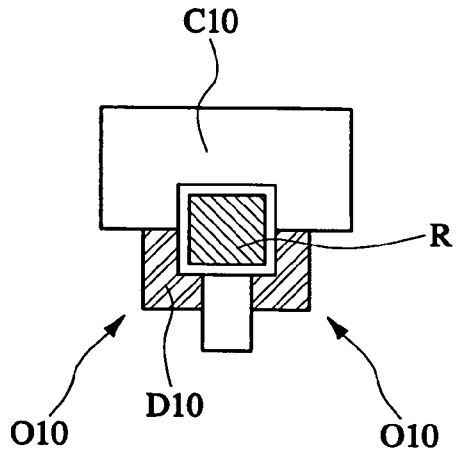
Figure 10B:
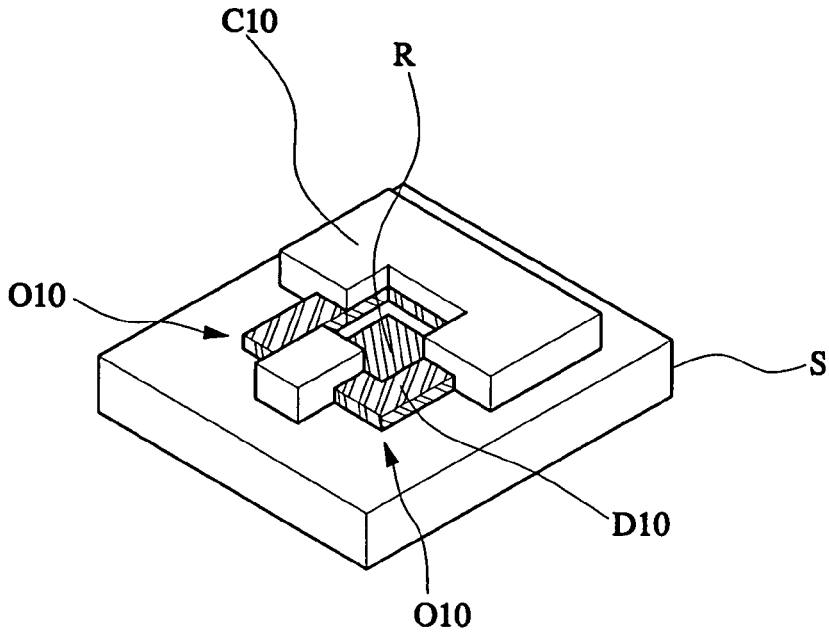
Figure 11A:
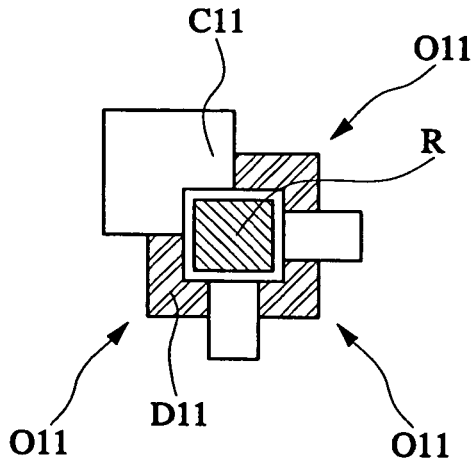
Figure 11B:
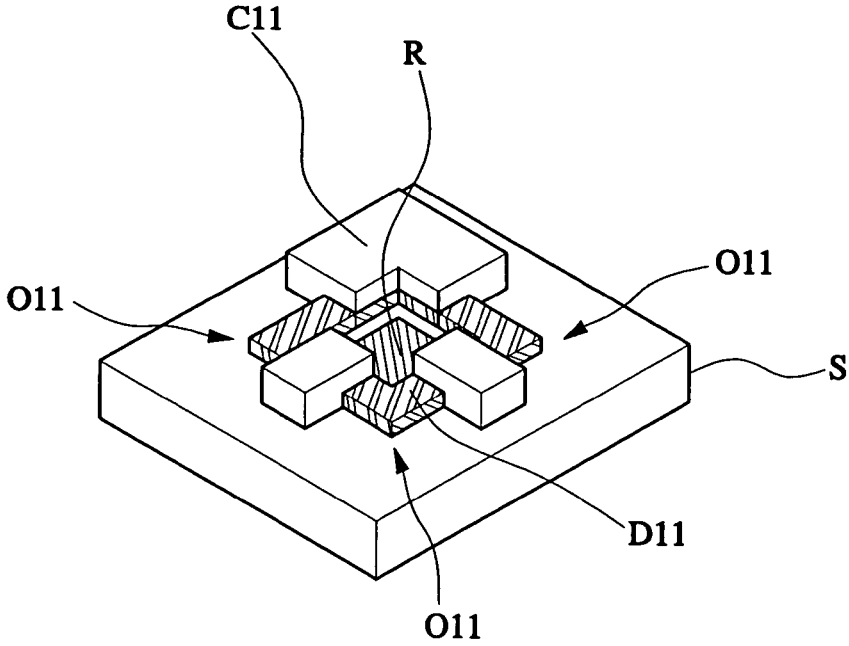

Referring to FIGS. 2A to 2C, a heat-generating resistor R is disposed on a substrate S. The heat-generating resistor R may be made of a high-melting point metal, such as tantalum (Ta), or its alloy. The heat-generating resistor R may have a square shape, viewing from a plan view. In addition, the heat-generating resistor R may be configured of two sub heat-generating bodies having a rectangular shape to form the square shape as a whole. The ink jet head has a barrier structure B to completely enclose the heat-generating resistor R in a direction parallel to a major surface of the substrate S. The barrier structure B includes a chamber layer C to partially enclose (surround) the heat-generating resistor R and to provide at least one opened portion O, and a channel damper D disposed at the opened portion O defined by the chamber layer C to completely enclose (surround) the heat-generating resistor R together with the chamber layer C. The chamber layer C has a first height H1 from the substrate S, and the channel damper D has a second height H2 lower than the first height. A nozzle layer NL is disposed to be in contact with an upper surface of the chamber layer C. The nozzle layer NL has a nozzle N corresponding to the heat-generating resistor R. An ink chamber IC is defined in an upper space of the heat-generating resistor R by the barrier structure B and the nozzle layer NL. The opened portion O defined by the chamber layer C is provided to function as an ink channel I to connect an ink feed channel (not shown) and the ink chamber IC. In accordance with an aspect of the present general inventive concept, a height H3 of the ink channel I may be determined by the channel damper D disposed at the opened portion O. That is, the height H3 of the ink channel I is determined by a difference between the first height H1 of the chamber layer C and the second height H2 of the channel damper D.

Hereinafter, the barrier structure B will be more specifically described.

As disclosed hereinabove, the barrier structure B includes the chamber layer C and the channel damper D. The chamber layer C may be made of a single resin layer having the first height from the substrate, or two resin layers including a lower chamber layer LC and an upper chamber layer UC. When the chamber layer C includes the lower chamber layer LC and the upper chamber layer UC, both the lower chamber layer LC and the channel damper D are made of the same resin layer and have the same second height from the substrate. The lower chamber layer LC and the channel damper D may be formed to enclose the heat-generating resistor R using the same material in the same process. Hereinafter, the description will be made regarding a configuration where the chamber layer C includes the lower and the upper chamber layers LC and UC. In addition, when the lower chamber layer LC and the channel damper D are designated together, the term named "chamber/damper layer" will be used. The substrate S may include a coating or protecting layer, a heat-resistance layer, and/or a conductive layer connected to the heat-generating resistor R, as is well known.

The chamber/damper layer may be either a thermosetting resin layer or a resin layer having a negative photosensitivity. Further, the chamber/damper layer encloses the heat-generating resistor R can have a rectangular frame shape with a first width W1 between an inner side and an outer side thereof in the direction parallel to the major surface of the substrate S. The upper chamber layer UC can be disposed to selectively cover the chamber/damper layer. As shown in FIG. 2C, the upper chamber layer UC may be disposed not to cover four corners of the heat-generating resistor R. As a result, a portion of the chamber/damper layer, which is exposed by the upper chamber layer UC, can be defined as the channel damper D, and a portion of the chamber/damper layer, which is covered by the upper chamber layer UC, can be defined as the lower chamber layer LC. The upper chamber layer UC may be either a thermosetting resin layer or a resin layer having a negative photosensitivity. The upper chamber layer UC may have an inner side spaced apart from the heat-generating resistor R by the same distance that the inner side of the lower chamber layer LC is spaced, and a second width W2 equal to or wider than the first width W1 between the inner side and the outer side thereof. As shown in FIGS. 2A to 2C, the upper chamber layer UC may have a width wider than the first width W1 so as to increase adhesion to the substrate.

The barrier structure B shown in FIGS. 2A to 2C can include the chamber layer C providing the opened portion O through which a corresponding one of the four corners of the heat-generating resistor R is opened (exposed), and the channel damper D disposed in the opened portion O. Four ink channels I having the height H3 defined by the channel damper D are defined in opened portions O. Ink provided through the ink feed channel (not shown) can be introduced into the ink chamber IC through the ink channels I. The introduced ink is instantly heated by the heat-generating resistor R to form bubbles. In accordance with an aspect of the present general inventive concept, the ink can be expanded through the four ink channels I. As a result, the ink jet head can reduce the expansion of the bubbles toward an exterior of the ink chamber compared with a conventional ink jet head having three-sided barrier structure, when the ink is ejected. Therefore, after the ink is ejected, new ink can be rapidly recharged through the four ink channels I.

Meanwhile, a shape of the barrier structure B to enclose the heat-generating resistor R may be variously modified. As long as additional description is not provided in the embodiments described hereinafter, the same named components as in FIGS. 2A to 2C may be referred to the same as the description in conjunction with FIGS. 3A to 4B.

FIGS. 3A to 7B are views illustrating barrier structures used with an image forming apparatus in accordance with other embodiments of the present general inventive concept. FIGS. 3A, 4A, 5A, 6A and 7A are plan views of the barrier structures, and FIGS. 3B, 4B, 5B, 6B and 7B are perspective views of the barrier structures shown in FIGS. 3A, 4A, 5A, 6A and 7A, respectively.

Referring to FIGS. 3A to 7B, the barrier structures each include a chamber layer C3, C4, C5, C6 or C7 formed on a substrate S to provide an opened portion O3, O4, O5, O6 or O7 through which at least one side of a heat-generating resistor R is opened (exposed), and a channel damper D3, D4, D5, D6 or D7 disposed at the opened portion O3, O4, O5, O6 or O7 to completely enclose (surround) the heat-generating resistor R together with the chamber layer D3, D4, D5, D6 or D7.

FIGS. 8A to 11B are views illustrating barrier structures in accordance with still other embodiments of the present general inventive concept. FIGS. 8A, 9A, 10A and 11A are plan views of the barrier structures, and FIGS. 8B, 9B, 10B and 11B are perspective views of the barrier structures shown in FIGS. 8A, 9A, 10A and 11A, respectively.

Referring to FIGS. 8A to 11B, the barrier structures each include a chamber layer C8, C9, C10 or C11 formed on a substrate S to provide an opened portion O8, O9, O10 or O11 through which at least one corner portion of a heat-generating resistor R is opened, and a channel damper D8, D9, D10 or D11 disposed at the opened portion O8, O9, O10 or O11 to completely enclose the heat-generating resistor R together with the chamber layer D8, D9, D10 or D11. Here, the at least one corner portion of the heat-generating resistor R may include predetermined portions of adjacent sides of the heat-generating resistor R.

Figure 12A:
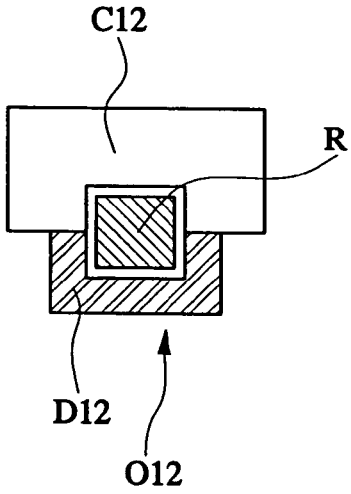
FIGS. 12A to 14B are views illustrating barrier structures in accordance with other embodiments of the present general inventive concept.
Figure 12B:
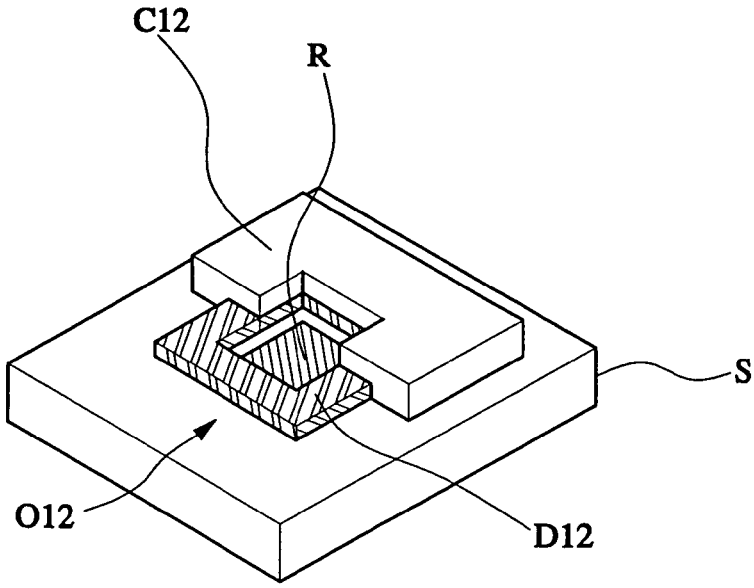
Figure 13A:
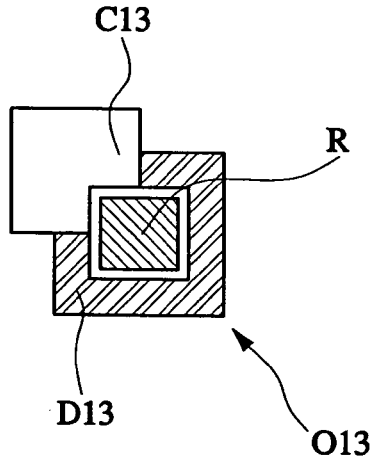
Figure 13B:
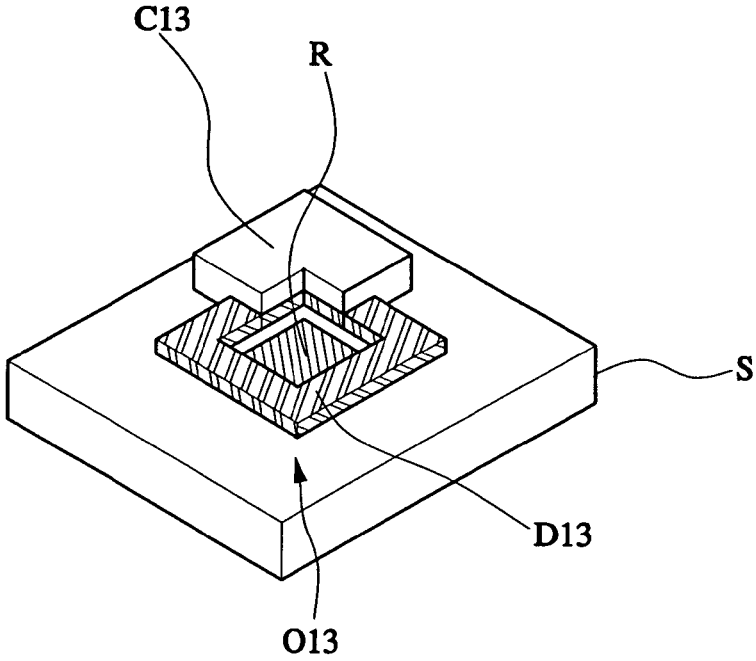
Figure 14A:
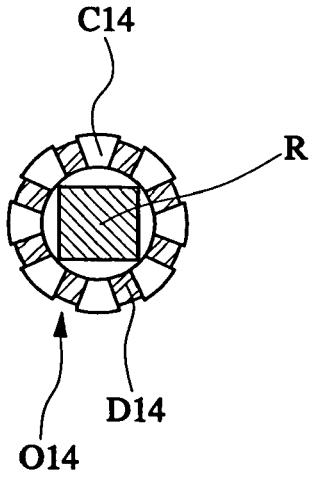
Figure 14B:
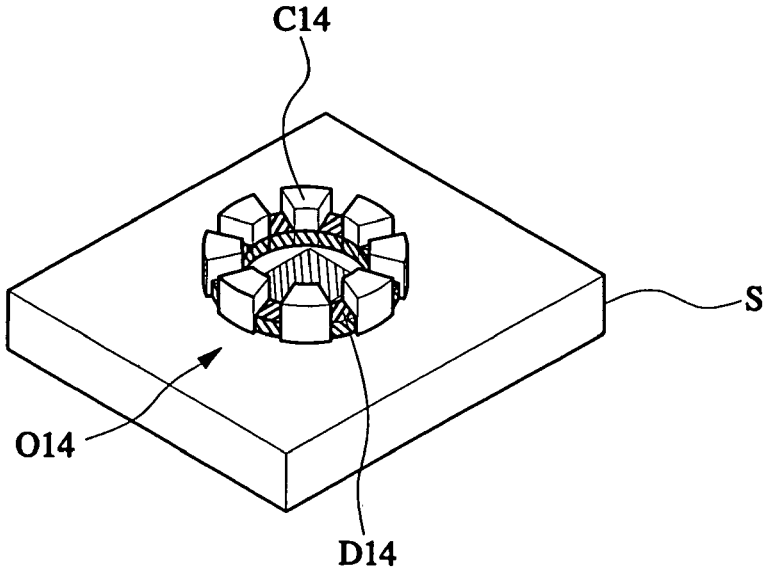

FIG. 12A to 14B are views illustrating barrier structures in accordance with other embodiments of the present general inventive concept. 12A to 14B, FIGS. 12A, 13A and 14A are plan views of the barrier structures, and FIGS. 12B, 13B and 14B are perspective views of the barrier structures shown in FIGS. 12A, 13A and 14A, respectively.

Referring to FIGS. 12A and 12B, the barrier structure includes a chamber layer C12 formed on a substrate S to provide an opened portion O12 through which one selected side of a heat-generating resistor R and both end corners of opposite sides with respect to the selected one side of the heat-generating resistor R are opened (exposed), and a channel damper D12 disposed at the opened portion O12 to completely enclose the heat-generating resistor R together with the chamber layer C12.

Referring to FIGS. 13A and 13B, the barrier structure includes a chamber layer C13 disposed on a substrate to provide an opened portion O13 through which three corners and predetermined portions of two sides between the three corners of the heat-generating resistor R are opened (exposed); and a channel damper D13 disposed at the opened portion O13 to completely enclose the heat-generating resistor R together with the chamber layer C13.

Referring to FIGS. 14A and 14B, the barrier structure may have an annular structure to enclose the heat-generating resistor R. That is, the barrier structure includes a chamber layer C14 to provide an opened portion O14 through which selected sections of the heat-generating resistor R are opened (exposed) and a channel damper D14 disposed at the opened portion O14 to completely enclose the heat-generating resistor R to form an annular shape. As described in FIGS. 2A to 2C, the chamber layer C14 may include a lower chamber layer and an upper chamber layer (not shown). In the annular structure, a chamber/damper layer including the lower chamber layer and the channel damper D14 may enclose the heat-generating resistor R. Although the opened portions O14 have the same interval as shown in FIGS. 14A and 14B, the opened portions O14 may be disposed to have different intervals. Accordingly, a length of the channel damper 14 in a circular direction may be different from other channel dampers 14. Furthermore, the barrier structure may be an elliptical structure or a polygonal structure.

Figure 15:
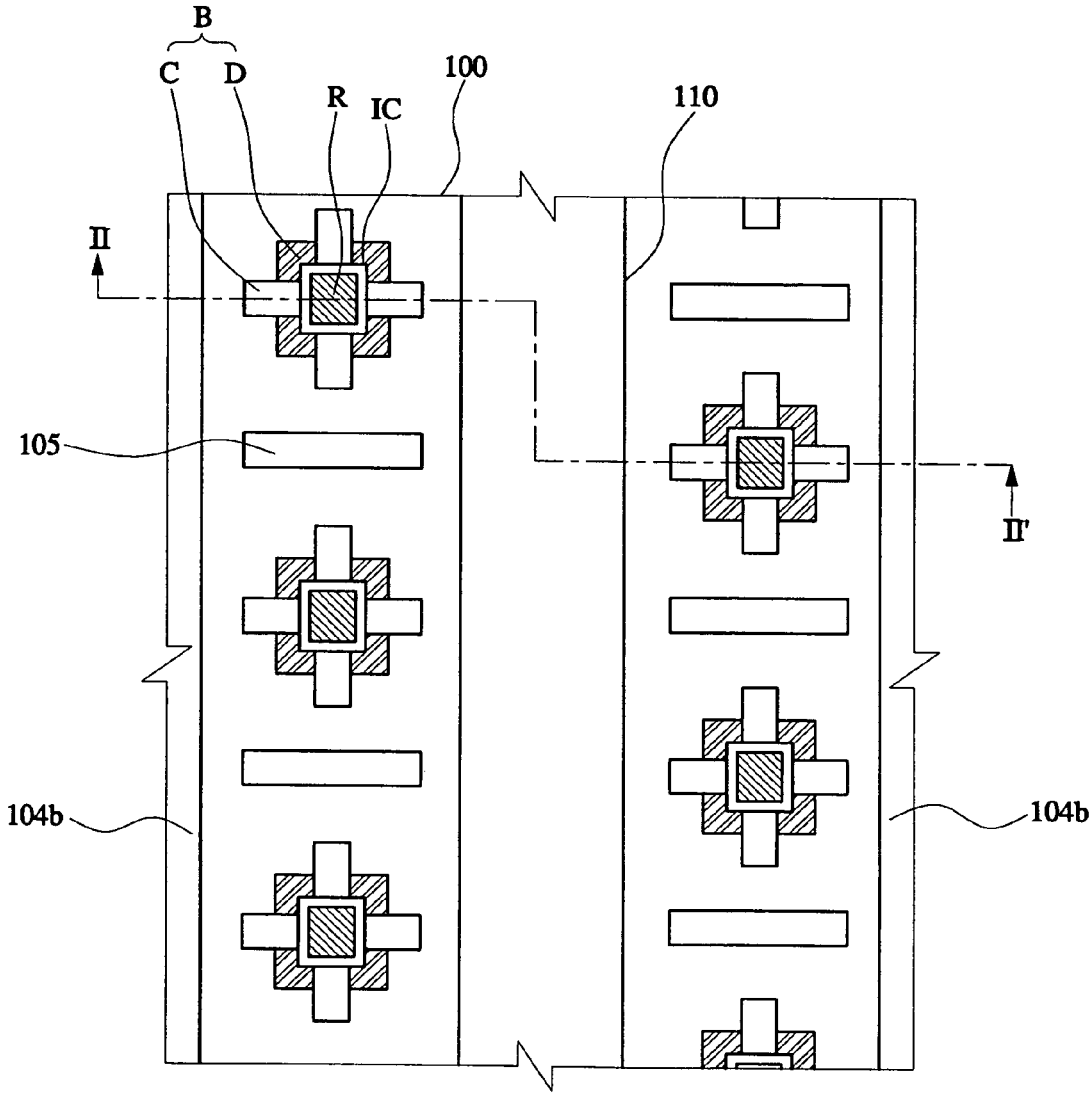
FIG. 15 is a partial plan view illustrating an ink jet head having a barrier structure in accordance with another embodiment of the present.

FIG. 15 is a partial plan view illustrating an ink jet head having a barrier structure in accordance with another embodiment of the present general inventive concept.

Referring to FIG. 15, a plurality of heat-generating resistors R are disposed on a substrate 100. The heat-generating resistors R may be disposed on the substrate 100 in a preset pattern. For example, the heat-generating resistors R may be arranged with two rows, and an ink feed channel 110 may be located between the heat-generating resistors R. In addition, the heat-generating resistors R may be arranged in a matrix pattern when the ink feed channel 110 is disposed at an appropriate position. Other layers and structures except the heat-generating resistors R may be further disposed on the substrate 100. For example, the substrate 100 may be covered with a thermal barrier layer, such as a silicone oxide layer. The heat-generating resistors R may be disposed on the thermal barrier layer. Further, metal wires to provide the heat-generating resistors R with electrical signals to eject the ink, and an isolative passivation layer to cover the heat-generating resistors R and the metal wires may be further disposed in the substrate S.

Barrier structures B to enclose the heat-generating resistors R are disposed, respectively. The barrier structure B includes a chamber layer C having a first height from the substrate 100, and a channel damper D having a second height lower than the first height. The ink chamber IC can be defined by an upper portion of the heat-generating resistors R and the barrier structures B. The barrier structures B may have the same structure as described in FIGS. 2A to 2C, and otherwise, have variously modified structures as described FIGS. 3A to 14B. The ink feed channel 110 is disposed to pass through the substrate 100 and may be disposed to have a line shape traversing one side of the barrier structure B. A nozzle layer (not shown) having a plate structure in contact with the upper surface of the chamber layer C can be disposed on the chamber layer C. The nozzle layer may have a nozzle disposed at a position corresponding to the upper surface of the heat-generating resistors R to eject the ink. Blocking layers 105 spaced apart from the barrier structure B may be disposed on the substrate 100 between the heat-generating resistors R. The blocking layers 105 can be disposed to prevent a cross talk of the adjacent nozzles when the ink is ejected and recharged, and may have a bar shape parallel to one side of the heat-generating resistor R. The blocking layers 105 may be formed in the same process as the chamber layer C, more specifically, the upper chamber layer described in FIGS. 2A to 2C. Thus, the blocking layers 105 and the upper chamber layer can be made of the same material layer and can have the same height. However, the blocking layers 105 may be omitted when the cross talk between the adjacent nozzles is prevented by the barrier structures B. Sidewalls 104*b* may be further disposed at both sides on the substrate to define a side end of a fluid channel provided as a moving path of the ink on the substrate. The sidewalls 104*b* also, similarly to the blocking layers 105, may be formed in the same process as the upper chamber layer and thus can be made of the same material layer and can have the same height as the upper chamber layer.

FIGS. 16A to 16E are cross-sectional views taken along a line II-II' in FIG. 15 to illustrate a method of fabricating an ink jet head in accordance with another embodiment of the present general inventive concept.

Figure 16A:
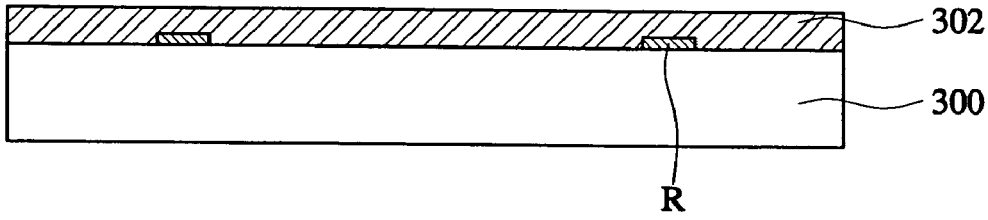
FIGS. 16A to 16E are cross-sectional views taken along a line II-II' in FIG. 15 to illustrate a method of fabricating the ink jet head of FIG. 15 in accordance with another embodiment of the present general inventive concept.

Referring to FIG. 16A, heat-generating resistors R are formed on a substrate 300. The heat-generating resistors R may be made of a high melting point metal, such as tantalum, or its alloy. The heat-generating resistors R may be formed by a method known to those skilled in the art, and a description of the known method will be omitted. A chamber/damper resin layer 302 can be formed on the substrate 300 having the heat-generating resistors R. The chamber/damper resin layer 302 may be formed with a thermosetting resin layer or a negative photosensitive resin layer having a chemical resistance to the ink using a spin coating method.

Figure 16B:
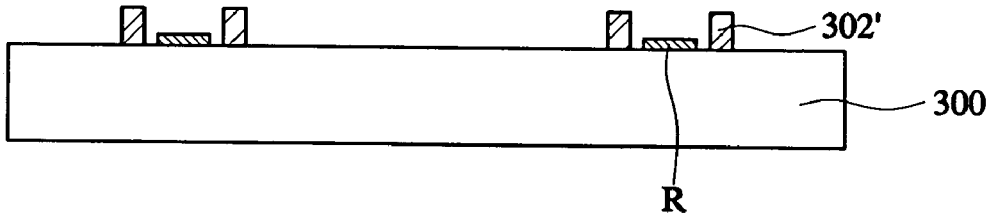

Referring to FIG. 16B, the chamber/damper resin layer 302 is patterned to form a chamber/damper layer 302' completely enclosing the heat-generating resistors R. The chamber/damper layer 302' may be patterned to have a rectangular frame structure to enclose the respective heat-generating resistors R in a direction parallel to a major surface of the substrate 300 and the heat-generating resistors R. The chamber/damper resin layer 302 may be patterned by a photolithography process or an anisotropic etching process. On the other hand, the chamber/damper layer 302' may be formed to have an annular structure to enclose the respective heat-generating resistors R. The chamber/damper layer 302' is formed to have the same height as the channel damper of FIG. 2B.

Figure 16C:
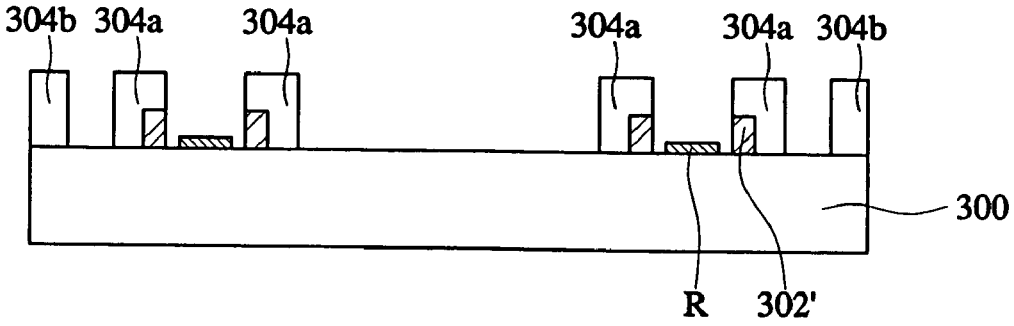

Referring to FIG. 16C, a chamber resin layer (not shown) is formed on the substrate 300 having the chamber/damper layer 302'. The chamber resin layer is formed to cover the chamber/damper layer 302' and can have the same height H1 from the substrate 300 as the chamber layer C described in FIG. 2B. Then, the chamber resin layer is patterned to form an upper chamber layer 304*a* to cover a predetermined section of the chamber/damper layer 302'. The upper chamber layer 304*a* is formed to open (expose) a predetermined portion of the heat-generating resistor R. In an aspect of the present general inventive concept, the upper chamber layer 304*a* may be formed to expose four corners of the heat-generating resistor R as shown in FIG. 15. As a result, the channel damper is defined to correspond to the four corners of the chamber/damper layer 302' exposed by the upper chamber layer 304*a*, and the lower chamber layer is defined to correspond to the chamber/damper layer 302' overlapped with the upper chamber layer 304*a*. Although the upper chamber layer 304*a* is formed on the chamber/damper layer 302' only, as shown in FIG. 16C, the upper chamber layer 304*a* may be formed to have a width wider than that of the chamber/damper layer 302' to be in contact with the substrate 300, thereby improving an adhesive property. On the other hand, in a process of patterning the chamber resin layer, the blocking layer (105 in FIG. 15) may be formed together. In addition, sidewalls 304*b* are formed on both sides of the substrate 300 to define a lateral end of a pathway provided as a moving path of the ink.

Figure 16D:
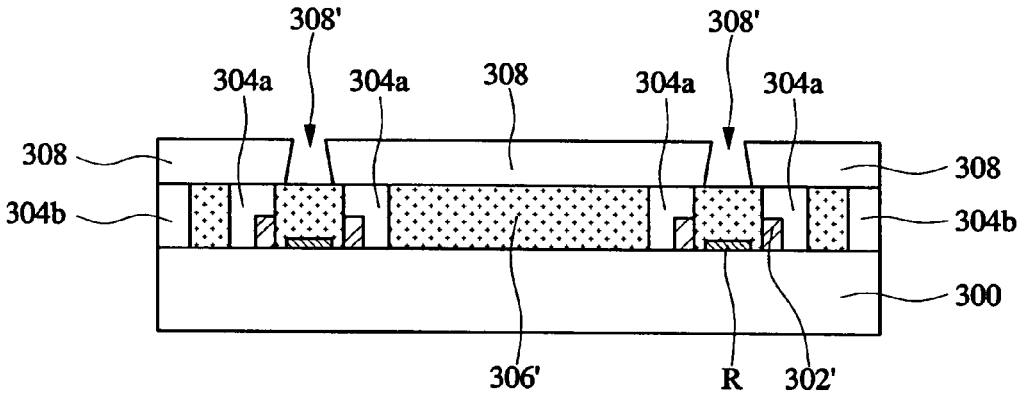

Referring to FIG. 16D, a sacrifice mold layer 306' is formed on the substrate 300 having the upper chamber layer 304*a*. The sacrifice mold layer 306' fills an empty space between the chamber/damper layer 302', the upper chamber layer 304*a* and the sidewalls 304*b*, and is formed to have the same height as the upper chamber layer 304*a*. The sacrifice mold layer 306' may be formed with a positive photosensitive resin layer which can be eliminated by a solvent. Then, a nozzle resin layer (not shown) is formed on the upper chamber layer 304 and the sacrifice mold layer 306', and the nozzle resin layer is patterned to form a nozzle layer 308 having a nozzle 308' at a position corresponding to an upper portion of the heat-generating resistor R. The nozzle resin layer may be formed with a negative photosensitive resin layer and patterned by a photolithography process.

Figure 16E:
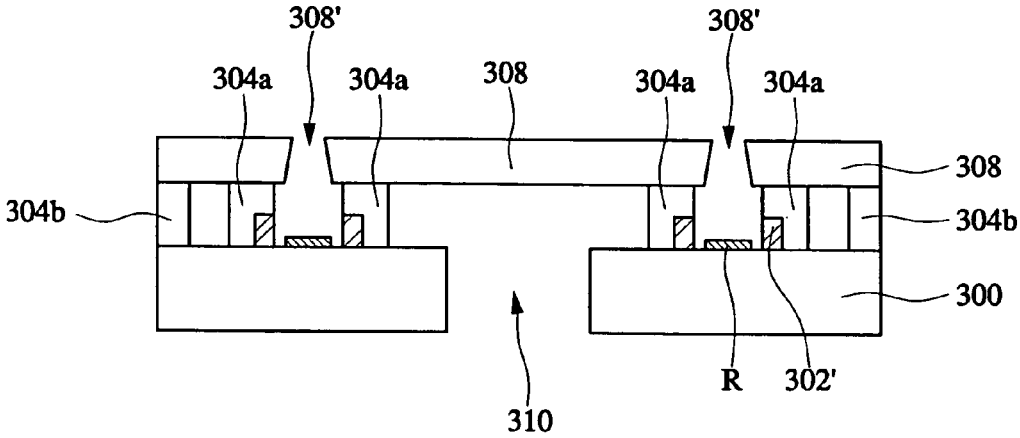

Referring to FIG. 16E, an ink feed channel 310 passing through a center of the substrate 300 is formed. The ink feed channel 310 may be formed through a known anisotropic etching process. Then, by using an appropriate solvent, the sacrifice mold layer 306' is eliminated by a wet etching process to finally form a pathway provided as a moving path of the ink at a section where the sacrifice mold layer 306' is eliminated.

Figure 17A:
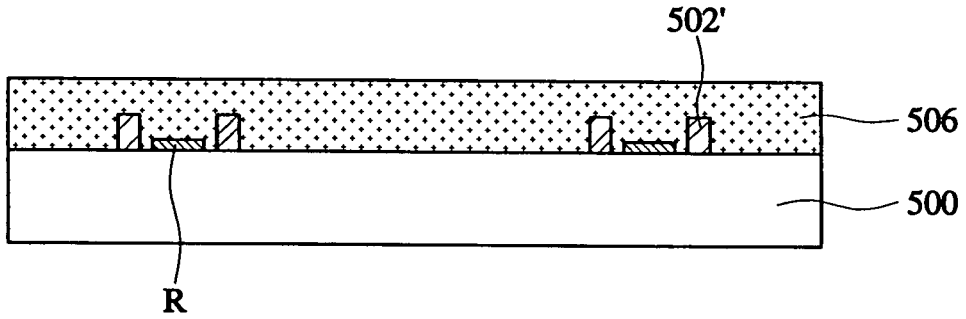
FIGS. 17A and 17B are cross-sectional views taken along the line II-II' in FIG. 15 to illustrate a method of fabricating the ink jet head in accordance with another embodiment of the present general inventive concept.
Figure 17B:
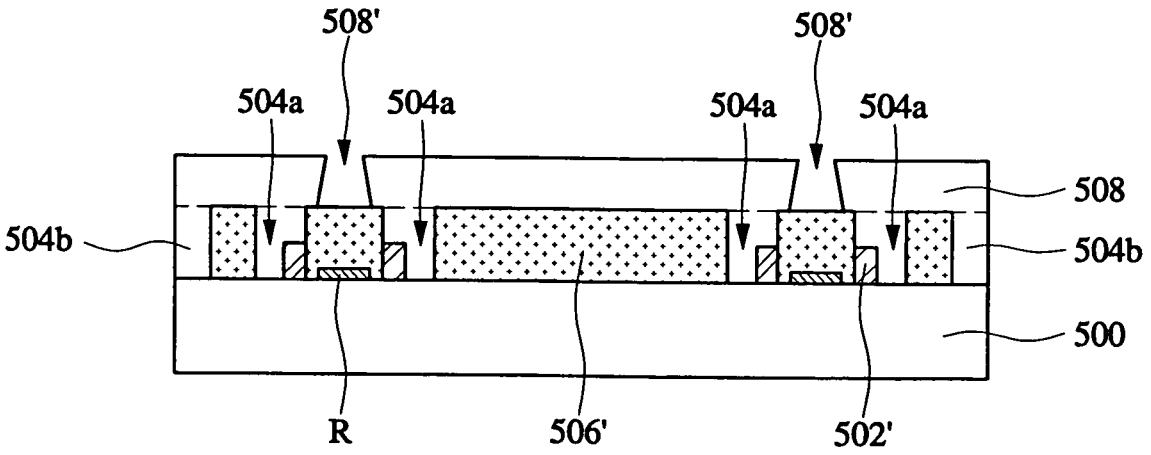

FIGS. 17A and 17B are cross-sectional views taken along the line II-II' in FIG. 15 to illustrate a method of fabricating the ink jet head in accordance with another embodiment of the present general inventive concept.

Referring to FIG. 17A, by accomplishing the same process as described in FIGS. 16A and 16B, a chamber/damper layer 502' to enclose the heat-generating resistors R is formed on a substrate 500. Then, a mold resin layer 506 is formed on the substrate 500 having the chamber/damper layer 502'. The mold resin layer 506 may be formed with a positive photosensitive resin layer. The mold resin layer 506 is formed to have the same height as the chamber resin layer described in FIG. 16C.

Referring to FIG. 17B, by accomplishing the photolithography process, the mold resin layer 506 is patterned to form a sacrifice mold layer 506'. The sacrifice mold layer 506' is formed to cover the section described in FIG. 16D. A resin layer (not shown), which a patterning is possible, for example, a negative photosensitive resin layer is formed at a front surface on the substrate having the sacrifice mold layer 506'. Then, the resin layer is patterned to simultaneously form a chamber layer 504*a*, a sidewall 504*b* and a nozzle layer 508 having a nozzle 5081 corresponding to a heat-generating resistors R. Then, the ink jet head is fabricated by accomplishing the same process as described in FIG. 16E.

A computer simulation was accomplished in order to measure ink ejection properties of the ink jet head having the barrier structure constructed in accordance with the present general inventive concept.

Figure 18A:
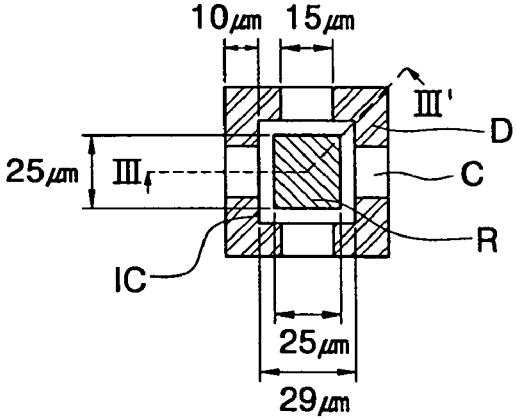
FIG. 18A is a plan view illustrating a standard and a dimension of a barrier structure used with an ink jet head in accordance with another embodiment of the present general inventive concept.
Figure 18B:
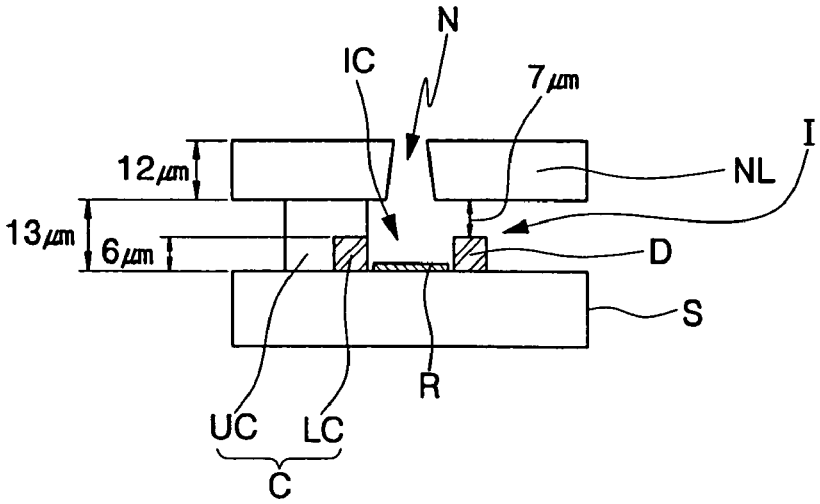
FIG. 18B is a cross-sectional view taken along a line III-III' in FIG. 18A.

FIG. 18A is a plan view illustrating a standard and a dimension of a barrier structure used for computer simulation of an ink jet head in accordance with an aspect of the present general inventive concept; and FIG. 18B is a cross-sectional view taken along a line III-III' in FIG. 18A. In FIGS. 18A and 18B, the barrier structure was designed to have the structure shown in FIGS. 2A and 2C. However, the width W2 of the chamber layer (C in FIG. 2A) was designed to be equal to the width W1 of the channel damper (D in FIG. 2A).

FIGS. 19A to 19F are views illustrating computer simulation results of the ink jet head having the barrier structure shown in FIGS. 18A to 18B. The computer simulation results were obtained after 0 μsec, 2 μsec, 4 μsec, 6 μsec, 9 μsec and 21 μsec have lapsed, on the basis of time when heat energy was generated from the heat-generating resistor, as shown in FIGS. 19A to 19F, respectively.

Figure 19A:
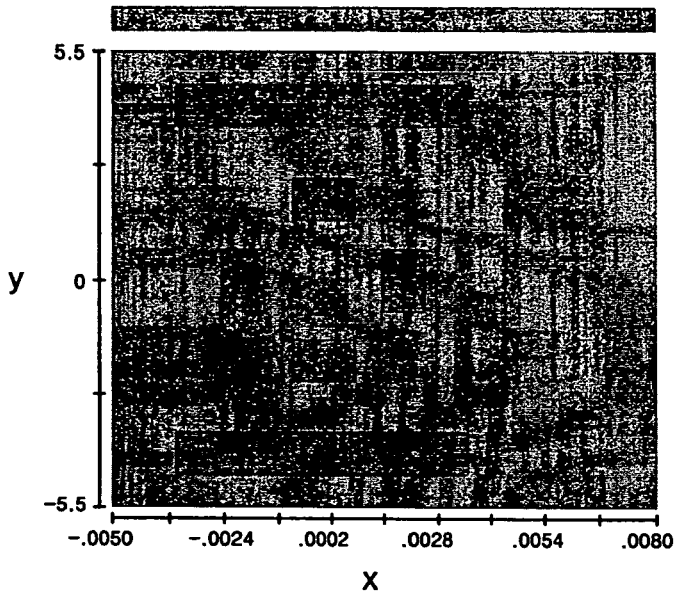
FIGS. 19A to 19F are views illustrating computer simulation results of the ink jet head having the barrier structure shown in FIGS. 18A and 18B.
Figure 19B:
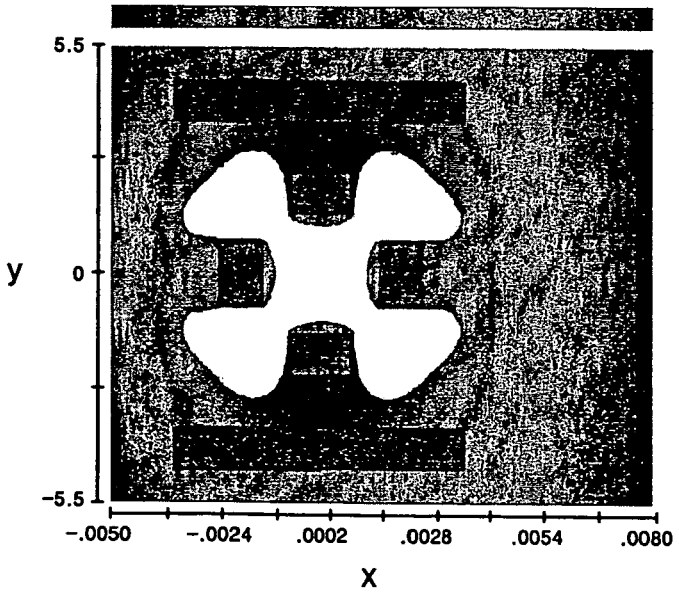
Figure 19C:
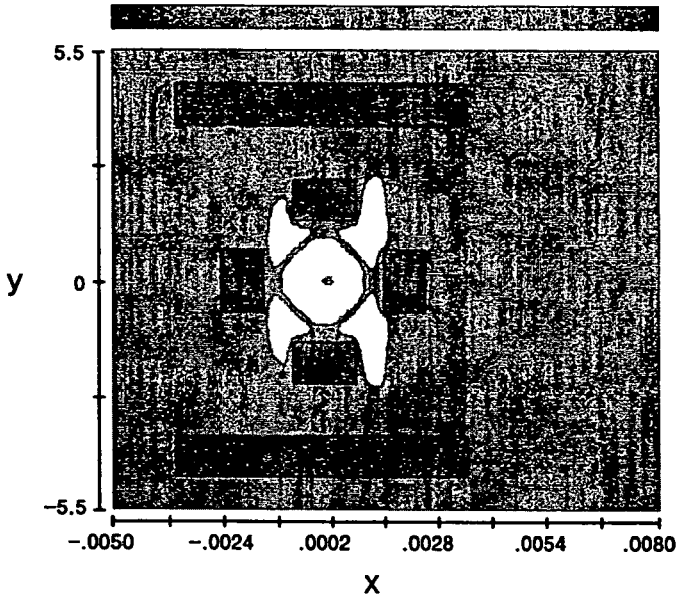
Figure 19D:
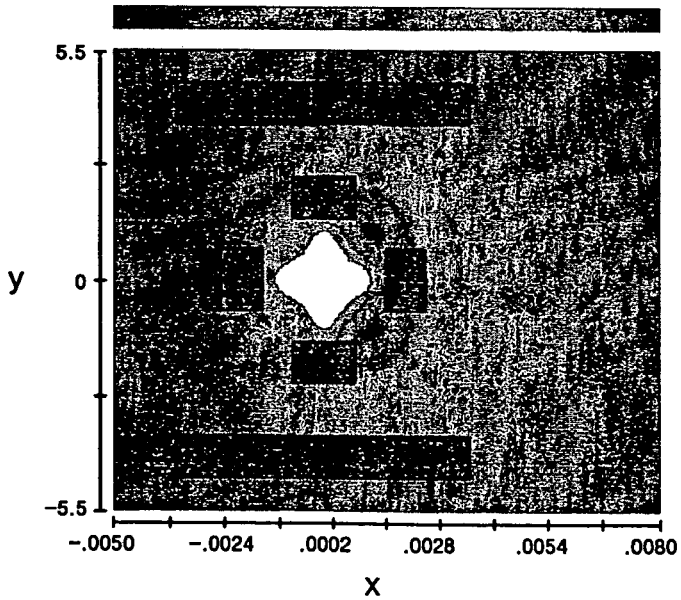
Figure 19E:
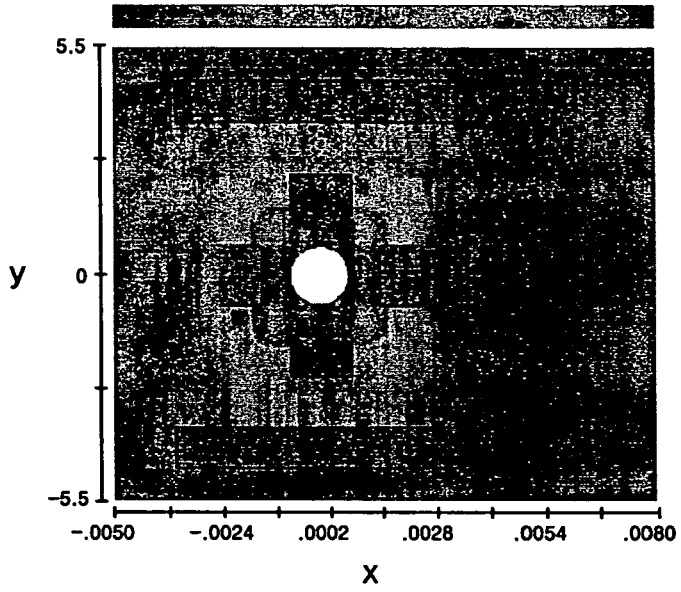
Figure 19F:
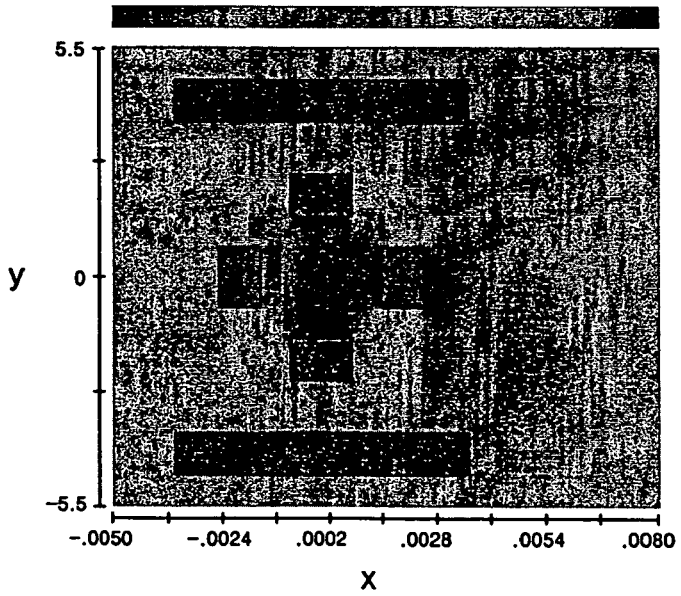

Referring to FIGS. 19A to 19F, the ejection of the ink droplet was started at the point of time that 2 μsec has lapsed. Bubbles generated at this time were expanded toward an exterior of the ink chamber as shown in FIG. 19B. However, the expansion of the bubbles has been dispersed through the four ink channels I as shown in FIGS. 18A and 18B, and a length of the expansion of the bubbles to the exterior of the ink chamber IC has been reduced. As a result, after the ejection of the ink, a recharging speed of the ink has been increased to complete the recharge of the ink after about 20 μsec has lapsed. And otherwise, maximum values of the ink ejection frequency, the ink ejection speed and a droplet volume have been measured to 30 KHz, 19.5 m/sec and 4.2 pl, respectively. These results represent that the ink ejection properties have been improved in comparison with a conventional ink jet head having a three-sided barrier structure having values of about 18 KHz, about 13 m/sec and about 4.5 pl. That is, a high ink ejection frequency means that the recharge of the ink into the ink chamber was easily accomplished after the ejection of the ink, and a high ink ejection speed means that high-speed printing is possible. In addition, since the droplet volume equal to or higher level than a reference droplet volume compared with the convectional droplet volume is maintained, the high-speed printing is possible while the high resolution being maintained.

As disclosed hereinabove, the ink jet head in accordance with the present general inventive concept is capable of increasing the ink ejection frequency and the ink ejection speed by reducing the back flow phenomenon of the ink during the ink ejection by forming the barrier structure provided with the channel damper.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink jet head comprising:

a substrate;

a heat-generating resistor disposed on the substrate;

a chamber layer disposed on the substrate to provide at least one opened portion, and having a first thickness;

a channel damper disposed at the opened portion to enclose the heat-generating resistor together with the chamber layer, and having a second thickness less than the first thickness; and a nozzle layer disposed on the chamber layer, wherein the channel damper is disposed at the opened portion adjacent to an ink chamber to define the sidewalls of the ink chamber.

2. The ink jet head according to claim 1, wherein the chamber layer comprises a lower chamber layer and an upper chamber layer to cover the lower chamber layer, and the lower chamber layer is made of the same material and has the same thickness as the channel damper.

3. The ink jet head according to claim 2, wherein the heat-generating resistor has a rectangular shape.

4. The ink jet head according to claim 3, wherein the channel damper and the lower chamber layer enclose the heat-generating resistor being spaced apart from the heat-generating resistor and form a rectangular frame structure with a first width between an inner side and an outer side thereof.

5. The ink jet head according to claim 4, wherein the upper chamber layer comprises a second inner side spaced apart from the heat-generating resistor by the same distance as the inner side of the lower chamber layer is spaced apart from the heat-generating resistor, and has a second width equal to or wider than the first width between the inner and outer sides of the rectangular frame structure.

6. The ink jet head according to claim 3, wherein at least one side of the heat-generating resistor is exposed through the opened portion.

7. The ink jet head according to claim 3, wherein at least one corner of the heat-generating resistor is exposed through the opened portion.

8. The ink jet head according to claim 3, wherein a selected one side and both end corners of the selected one side of the heat-generating resistor are exposed through the opened portion.

9. The ink jet head according to claim 3, wherein three corners and two sides between the three corners of the heat-generating resistor are exposed through the opened portion.

10. The ink jet head according to claim 3, wherein the channel damper and the lower chamber layer form an annular structure to enclose the heat-generating resistor.

11. The ink jet head according to claim 3, further comprising:

an ink feed channel disposed to pass through the substrate and communicate with an ink channel defined by the chamber layer.

12. The ink jet head according to claim 11, wherein the ink feed channel is formed in a line shape traversing one side of the chamber layer and the channel damper enclosing the heat-generating resistor.

13. The ink jet head according to claim 3, further comprising:

a blocking layer disposed on the substrate to be spaced apart from the chamber layer and the channel damper and disposed on one side of the heat-generating resistor.

14. The ink jet head according to claim 13, wherein the blocking layer is made of the same material layer as the upper chamber layer and has the same first thickness as the chamber layer.

15. The ink jet head according to claim 14, wherein the blocking layer has a bar shape parallel to one side of the heat-generating resistor.

16. The ink jet head according to claim 1, wherein the chamber layer is formed integrally with the nozzle layer.

17. The ink jet head of claim 1, further comprising:

a passivation layer between the heat-generating resistor and the chamber layer.

18. The ink jet head of claim 17, further comprising:

an anti-cavitation layer formed on the passivation layer.

19. A method of fabricating an ink jet head, the method comprising:

forming a heat-generating resistor to generate a pressure for ink ejection on a substrate;

forming a chamber layer on the substrate having a first thickness to provide at least one opened portion;

forming a channel damper disposed at the opened portion to enclose the heat-generating resistor together with the chamber layer and having a second thickness less than the first thickness; and forming a nozzle layer disposed on the chamber layer, wherein the channel damper is disposed at the opened portion adjacent to an ink chamber to define the sidewalls of the ink chamber.

20. The method according to claim 19, wherein the forming of the chamber layer, the channel damper, and the nozzle layer comprises:

forming a chamber/damper layer on the substrate to define the ink chamber and to enclose the heat-generating resistor;

forming an upper chamber layer on the substrate having the chamber/damper layer and on a predetermined section of the chamber/damper layer to define the channel damper with the chamber/damper layer exposed by the upper chamber layer; and forming the nozzle layer having the nozzle to be in contact with an upper surface of the upper chamber layer.

21. The method according to claim 20, wherein the forming of the chamber/damper layer comprises:

forming a chamber/damper resin layer on a top surface of the substrate having the heat-generating resistor; and patterning the chamber/damper resin layer to form the chamber/damper layer.

22. The method according to claim 21, wherein the chamber/damper layer is formed to have a rectangular frame structure to enclose the heat-generating resistor.

23. The method according to claim 21, wherein the chamber/damper layer is formed to have an annular structure to enclose the heat-generating resistor.

24. The method according to claim 20, further comprising:

forming an ink feed channel passing through the substrate.

25. An ink jet head comprising:

a substrate;

a heat-generating resistor disposed on the substrate;

a barrier structure to define an ink chamber, the barrier structure comprising, a chamber layer having at least one portion disposed on the substrate to have a first thickness, at least one opened portion formed between adjacent end portions of the at least one chamber layer, and at least one channel damper disposed at the at least one opened portion to have a second thickness less than the first thickness and to enclose the heat-generating resistor together with the at least one portion of the chamber layer; and a nozzle layer disposed on the chamber layer, wherein the channel damper is disposed at the opened portion adjacent to an ink chamber to define the sidewalls of the ink chamber.

26. The ink jet head according to claim 25, wherein the at least one channel damper protrudes from the substrate toward the nozzle layer by the second thickness to form an ink channel having an area narrower than that of the at least one opened portion.

27. The ink jet head according to claim 25, wherein the at least one channel damper forms an ink channel with the nozzle layer to prevent a back flow phenomenon between the ink chamber and the ink channel when ink contained in the ink chamber is ejected from the ink chamber.

28. The ink jet head according to claim 27, wherein the at least one channel damper prevents a back flow phenomenon between the ink chamber and the ink channel so that a volume of the ink droplet is maintained equal to or greater than a reference value.

29. The ink jet head according to claim 27, wherein the ink channel has a third thickness equal to or less than a difference between the first thickness and the second thickness.

30. The ink jet head according to claim 25, further comprising:

a second heat-generating resistor disposed on the substrate and spaced apart from the heat-generating resistor; and a second barrier structure spaced apart from the barrier structure to define a second ink chamber, comprising, a second chamber layer having at least one portion disposed on the substrate to have the first thickness, at least one second opened portion formed between adjacent end portions of the at least one portions of the second chamber layer, at least one second channel damper disposed at the at least one second opened portion between the adjacent end portions to enclose the second heat-generating resister together with the at least one portion of the second chamber layer, and having the second thickness less than the first thickness, wherein the second channel damper is disposed at the second opened portion adjacent to the second ink chamber to define the sidewalls of the second ink chamber.

31. The ink jet head according to claim 30, further comprising:

an ink channel formed between the substrate and the nozzle layer to provide a first passage and a second passage to supply ink to the barrier structure and the second barrier structure, respectively; and a side wall formed between the substrate and the nozzle layer.

32. The ink jet head according to claim 31, wherein the sidewall is spaced apart from both the barrier structure and the second barrier structure to provide a first ink passage and a second ink passage therebetween, respectively.

33. The ink jet head according to claim 30, further comprising:

an ink channel formed between the substrate and the nozzle layer to provide a passage through which at least one opened portion communicates with the at least one second opened portion; and a blocking wall formed on the substrate in the ink channel between barrier structure and the second barrier structure to provide a second passage narrower than the passage of the ink channel.

34. The ink jet head according to claim 33, wherein the blocking wall has a third thickness less than the first thickness and more than the second thickness.

35. The ink jet head according to claim 33, wherein the blocking wall has a third thickness more than the second thickness.

36. The ink jet head according to claim 25, wherein the chamber layer is formed integrally with the nozzle layer.

37. The ink jet head of claim 25, further comprising:

a passivation layer between the heat-generating resistor and the chamber layer.

38. The ink jet head of claim 37, further comprising:

an anti-cavitation layer formed on the passivation layer.

39. An ink jet head, comprising:

a substrate;

a heat-generating resistor disposed on the substrate;

a chamber layer disposed on the substrate having at least one opened portion, the chamber layer having a first thickness;

a channel damper disposed at the opened portion and having a second thickness less than the first thickness; and a nozzle layer disposed on the chamber layer, wherein the channel damper is disposed at the opened portion adjacent to the ink chamber to define the sidewalls of the ink chamber.

40. The ink jet head according to claim 39, wherein the chamber layer is formed integrally with the nozzle layer.

41. The ink jet head of claim 39, further comprising:

a passivation layer between the heat-generating resistor and the chamber layer.

42. The ink jet head of claim 41, further comprising:

an anti-cavitation layer formed on the passivation layer.

43. An ink jet head, comprising:

a substrate;

a heat-generating resistor disposed on the substrate;

a chamber layer disposed on the substrate having at least one opened portion;

a channel damper disposed at the opened portion to enclose the heat-generating resistor together with the chamber layer; and a nozzle layer disposed on the chamber, wherein the channel damper is disposed at the opened portion adjacent to the ink chamber to define the sidewalls of the ink chamber.

44. The ink jet head according to claim 43, wherein the chamber layer comprises a lower chamber layer and an upper chamber layer to cover the lower chamber layer, the lower chamber layer being made of the same material as the channel damper.

45. The ink jet head according to claim 43, wherein the chamber layer is formed integrally with the nozzle layer.

46. The ink jet head of claim 43, further comprising:

a passivation layer between the heat-generating resistor and the chamber layer.

47. The ink jet head of claim 46, further comprising:

an anti-cavitation layer formed on the passivation layer.

* * * * *